United States Patent [19]

Poschet

[11] Patent Number: 4,659,883

[45] Date of Patent: Apr. 21, 1987

[54] REPEAT LOCK AND INHIBITOR FOR STARTERS OF COMBUSTION ENGINES

[75] Inventor: Klaus Poschet, Baldham, Fed. Rep. of Germany

[73] Assignee: Schaltbau GmbH, Munich, Fed. Rep. of Germany

[21] Appl. No.: 769,473

[22] Filed: Aug. 26, 1985

[30] Foreign Application Priority Data

Sep. 1, 1984 [DE] Fed. Rep. of Germany ..... 3432256

[51] Int. Cl.[4] ..... H01H 27/08

[52] U.S. Cl. ..... 200/43.03; 200/43.08

[58] Field of Search ..... 200/43.03, 43.08; 70/252, 255, 237, 285, 277, DIG. 5; 123/179 C

[56] References Cited

U.S. PATENT DOCUMENTS

| | | | |
|---|---|---|---|
| 3,621,159 | 11/1971 | Heap | 200/43.03 |
| 4,292,483 | 9/1981 | Roytberg | 200/43.03 |
| 4,298,776 | 11/1981 | Sondermann | 200/43.03 |

FOREIGN PATENT DOCUMENTS

| | | | |
|---|---|---|---|
| 697973 | 1/1931 | France | 200/43.08 |
| 1160140 | 7/1969 | United Kingdom | 200/43.03 |
| 1223439 | 2/1971 | United Kingdom | 200/43.03 |

*Primary Examiner*—Stephen Marcus
*Assistant Examiner*—Linda J. Sholl
*Attorney, Agent, or Firm*—Ralf H. Siegemund

[57] ABSTRACT

Restart of a running engine is prevented by a slide lock in a disk rotating upon ignition key turning and cooperating with stops and cams to define and limit positions of the slide lock in relation to turning angles. The slide lock as held by a spring bias lock element cooperating with a pair of grooves.

5 Claims, 7 Drawing Figures

REPEAT LOCK AND INHIBITOR FOR STARTERS OF COMBUSTION ENGINES

BACKGROUND OF THE INVENTION

The present invention relates to a repeat lock and inhibitor for cooperation with an ignition key, which is turned in a lock for operating the start in a combustion engine.

Usually, combustion engines are started by means of a starter which is usually an electro motor. Herein it is necessary to avoid that the starter is operated again when the engine already runs, or still runs. Such repeated operation of the starter could damage the engine, as well as the starter motor.

DESCRIPTION OF THE INVENTION

It is an object of the present invention to provide a new and improved repeat lock, of the type referred to above, which reliably prevents repeated operation of a starter switch, even when considerable force is exerted. The lock is made to be made with as few moveable parts as possible and should be generally easy to make with only the most simple maintenance required.

In accordance with the preferred embodiment of the present invention, the repeat lock should be constructed to have the following combination or features.

The repeat lock includes a disk which rotates about its center and axis when the ignition key is turned in the key lock;

this disk is coaxially arranged in a cylindrical interior of a case whose cylindrical was generally of larger diameter than the disk and being part of stationary housing;

this disk has a chord like channel or indent of rectangular cross section, with a longitudinal boundary running through the center of the disk;

a slide lock is arranged in that chord like channel to be moveable therein over a limited length, and whose longest side runs along said boundary of the channel which includes the center, the length of that side is equal to the diameter of the disk, plus half of the difference of the diameters of the wall and of the disk whereby the front ends of the slide lock are arc shaped portions of the cylindrical surface of the disk, which as far as the two end positions of the slide lock are concerned complement the adjacent circular periphery of the disk;

the slide lock is held in one of two end positions by means of a blade or edge being slidable in the disk, against the force of a spring and in a direction transverse to the slide lock extension, which edge in each of the end positions engages one of two juxtaposed V-shaped slots in the slide lock, whereby the common juncture line of the two juxtaposed slots runs transversely to the largest length dimensions of the slide lock in these end positions one or the other end of the slide lock projects from the disk, while the respective other end is flush with the circular periphery of the disk;

A first stop extends radially inwardly from the cylindrical interior wall of the aforementioned interior space against which abuts the first end of the slide lock in a resting position, and whenever the slide lock has one of its end positions. In addition a second and a third, radially inwardly extending stop are provided in a short angular distance from the first stop and being separated by a shoulder; the second end of the slide lock will abut against the second stop when the disk has been turned into the starting position, but the slide lock is prevented from completely reaching the other second end position, by means of the shoulder being situated ahead of the second stop, and being configured as a reduction of the radius of the interior space, so that the slidable edge or blade will penetrate only a portion of the depth of one of the two grooves.

The end of the shoulder constitutes a third radially inwardly directed stop, against which will abut the slide lock when in the second end position to thereby lock the device against undesired repetition of the starting operation; two cams are provided, generally opposite the stops on the cylindrical wall of the interior space, a first one of the cams moves the slide lock, pursuant to rotation of the disk, out of a resting (first end) position of the slide lock, as soon as the second end of the slide lock has a position opposite the shoulder. The movement is carried out over a limited length and by that first cam to cause the second end of the slide lock to abut the shoulder. Under these conditions, the edge will not completely penetrate into one of the grooves, but the spring bias will cause the edge to shift the slide lock into the second end position as soon as on return of the disk the slide lock clears the shoulder. The second cam, upon return of the disk into the rest position, returns the slide lock from the second end position to the first end position permitting abutment at the first step. The edge lodges in the other grooves as soon as the slide lock has been returned to the first end position.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Figure 1:
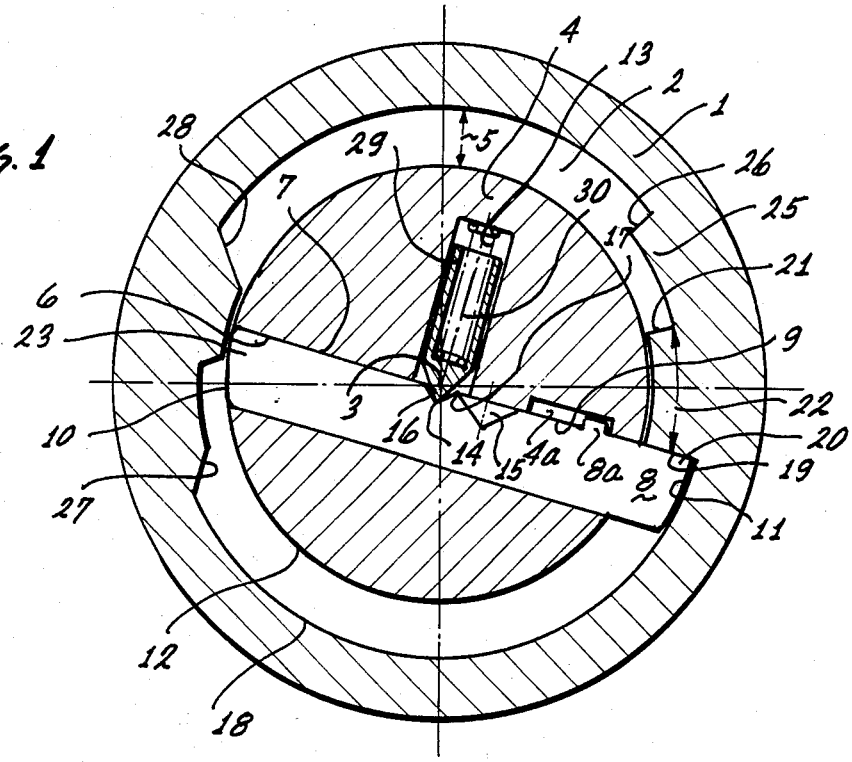
FIGS. 1 through 6 are basically similar cross sections through a repeat lock in accordance with the preferred embodiment of the present invention, for practicing the best mode thereof, the figures differ merely by operating positions.
Figure 7:
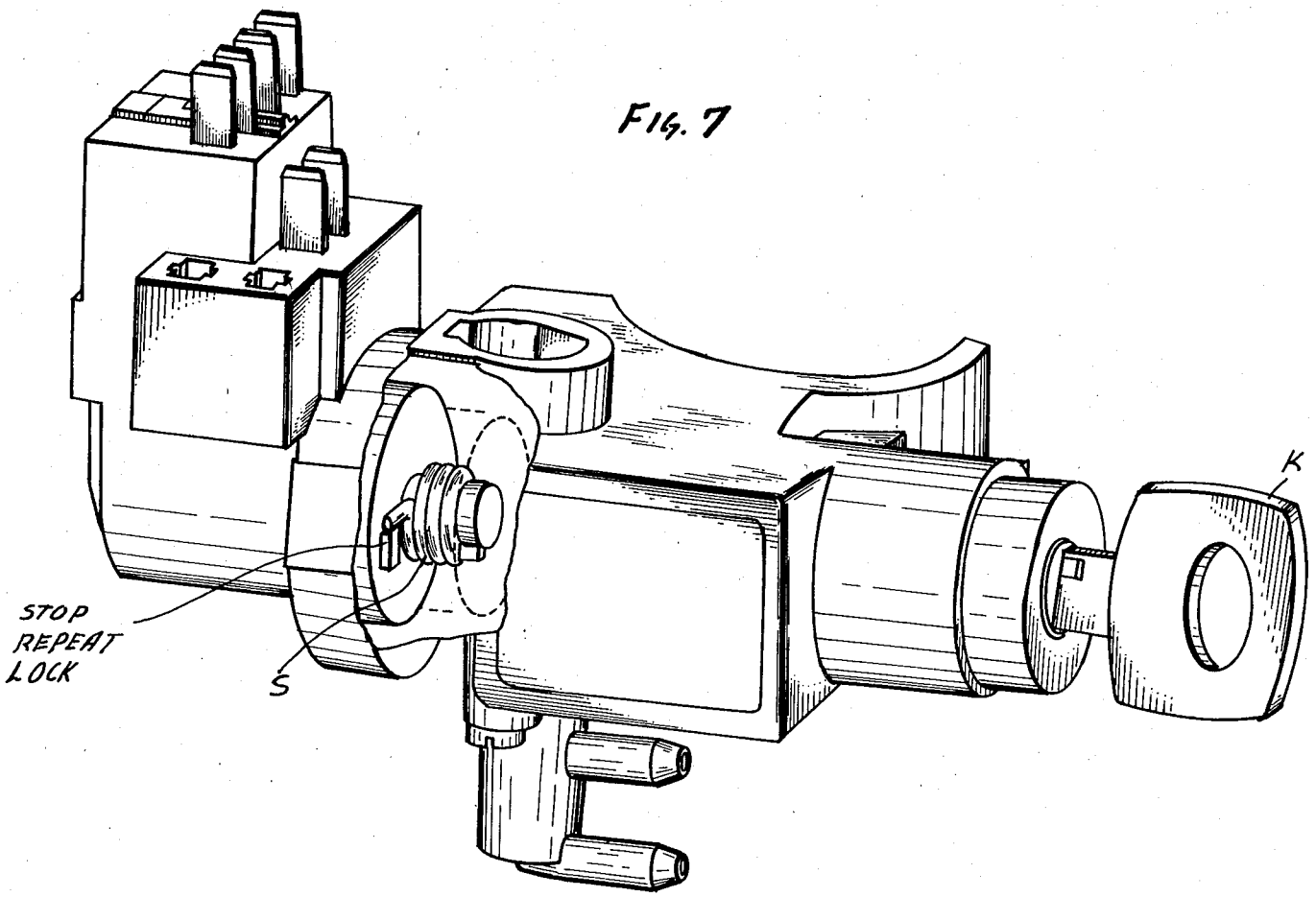
FIG. 7 is a perspective view of a ignition key with lock incorporating the repeat lock of FIGS. 1–5.

Proceeding now to the detailed description of the drawings, FIG. 1, which as stated, shows the repeat lock in resting, normal or neutral position. The lock includes a stationary, basically cylindrical case or housing 1, having a more or less complex contoured interior space 2, but the wall 18 could be regarded as being of a cylindrical configuration, with certain wall modifications to be described more fully below. This cylinder nevertheless has a center 3, being in fact the center of the various circular portions shown in representation of the wall of casing 1. A disk 4 is coaxially arranged with respect thereto and inside of the space 2. The center axis of the disk, as well as of the cylinder extends of course transversely to the plane of the drawing. The disk 4 will be turned or can be turned by means of an ignition key (FIG. 7, see also for a detailed operation my copending application—Ser. No. 769,472 filed Aug. 26, 1985).

The diameter of the interior space 2, is proportioned as follows. It is first of all equal to the sum of the following (geometric) components. The first component is the diameter of the disk 4 to which is added twice a length value 5 indicated in FIG. 1, which length value 5 plays a significant part in the dimensioning of various parts below, but it can also be deemed to be the radial width of the gap between the circular or cylindrical periphery of disk 4 and the circular portions of the wall of the inner wall of casing 1.

Disk 4 is provided with a chord like indent or channel 6 of rectangular cross section. The channel 6 is, therefore, not symmetrical vis-a-vis the center 3 of the disk 4. One long side or border 7 of this however is situated such that the center 3 is in fact located in that border wall 7.

A slide lock element 8, is slidably disposed inside indent or channel 6. The longest side 9 of this lock abuts surface 7. This longest side 9 has a length value which is of course taken in the long dimension of the slide lock, and its particular value is equal to the diameter of disk 4, plus half the diameter difference or equal to the gap width 5. Front end faces 10 and 11 of the slide lock 8 are arcuately shaped, i.e. they are circular arc sections, complementing the cylindrical surface 12 of the disk 4 across the channel ends and are thus capable of complementing that surface circular periphery of disk 4, of individually and only in the respective end positions of the slide lock 8. A groove 4*a* in disk 4 cooperates with a stop element or lug 8*a* for limiting the displacement of element 8 vis-a-vis disk 4 independently from external action or element 8.

Figure 5:
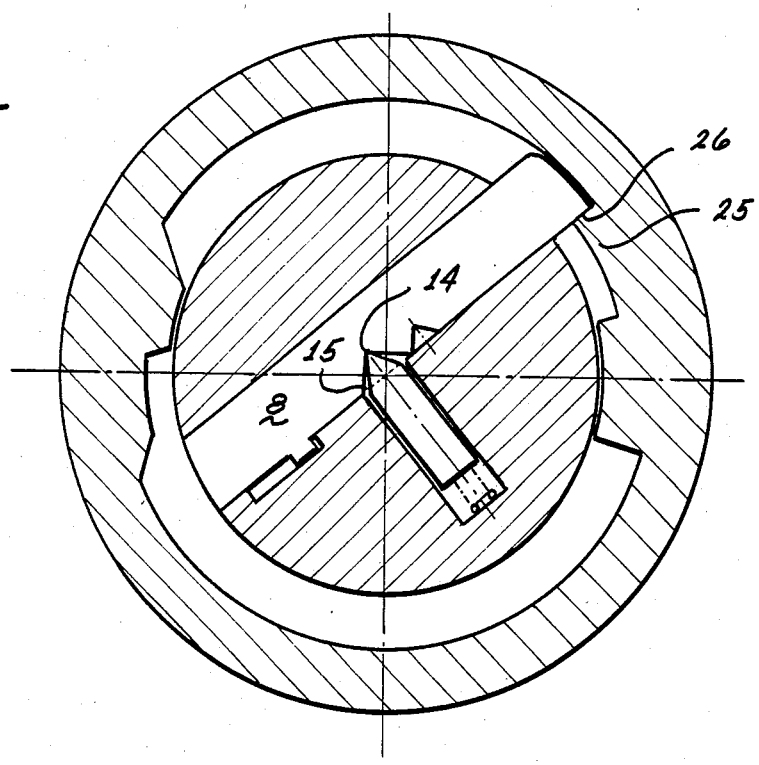

One of the end positions of slide lock 8 is shown in FIG. 1, and can be referred to as the first end position; the end 20 of slide lock 8 having end face 11 is also referred to as the first end; the other (second) end position is shown in FIG. 5 wherein the second end, 23, of the slide lock is fully extended. In each of the two end positions, slide 8 is held by means of a blade or edge 14. This edge 14 is biased into a slide engaging position, by means of a compression spring 13. In accordance with a particular feature, the slidable edge and lock element 14 is constructed as being the end of a pin 29 or a sleeve (i.e. a hollow pin). The interior of that pin is a blind bore 30 to receive the compression spring 13. The direction of slpring bias force and engaging action by the blade or edge 14 is perpendicular to the length extension of the slide lock 8 and its direction of displacement in channel 6. The end positions in which the slide lock 8 can be held are given vis-a-vis the edge 14 by means of V-shaped grooves or indents 15 and 16. These two grooves are juxtaposed and they have a common border 17. These common line 17 runs perpendicular to the length dimension 9 of the slide but also in parallel to the axis of rotation of the disk 4. The grooves are differently deep and wide for reasons that will become apparent when the operation of the device is being described.

The cylindrical inside wall 18 of the space 2, is provided with a first stop 19, running from that wall in radially inward direction. The one (first) end 20, or the slide lock and taken on the long side 9 of the slide lock 8, will in the resting (first) position of the slide lock project from the disk 4 and abut that first stop 19. This is indeed shown in FIG. 1.

A second, radially inwardly projecting stop 21 is spaced from the stop 19 at a fairly small angular distance 22. The second end 23 of the slide lock 8 taken in a direction of the long side 9 will abut that stop 21 (see FIG. 4) on ignition; but the slide lock 8 is prevented from reaching the other (second) end position by operation of a shoulder 25 spaced from the stop 21 over an arc of angular width 24. This shoulder 25 is defined by a radial inner extension from wall 18 but extends not as far as the stop 19, but its diameter is still smaller than the diameter of wall 18. Therefore whenever, as for example shown in FIG. 4, the end 23 of the slide lock 8 abuts that shoulder 25, it is in fact prevented from reaching the second end position. This means that the slide 14 can not completely penetrate the groove 15 and will lodge somewhere along the V-shaped wall of that groove 15.

A stop 26 is in fact a third stop and established at the end of the shoulder 25. This stop 26 provides for the prevention of the undesirable repeat operation of an ignition in that the end 23 of the slide lock 8, when abuting this third stop 26, cannot be turned further (clockwise) to reach the starter position (abutment with stop 21).

Radially opposite to stops 21, 26 and 19 are positioned two cams 27 and 28. These cams are also radially inward projections, projecting from the cylindrical wall 18. The first one of the two, 27 and being shown in a specific operating conditions in FIGS. 2 and 3, has the function of shifting the slide lock 8 from the first end position (FIGS. 1, 2) through a certain distance, as soon as persuant to the rotation of the disk 4 from resting position, this second end 23 faces the shoulder 25 as shown in FIG. 3. The position therefore is that upon turning the disk 4 clockwise the engagement of cam shoulder 27 with the end 20 of the slide lock 8 will cause the element 18, as indicated in dotted lines in FIG. 3, the slide 8 to be shifted from the first end position to the intermediate position shown in FIG. 4.

Figure 6:
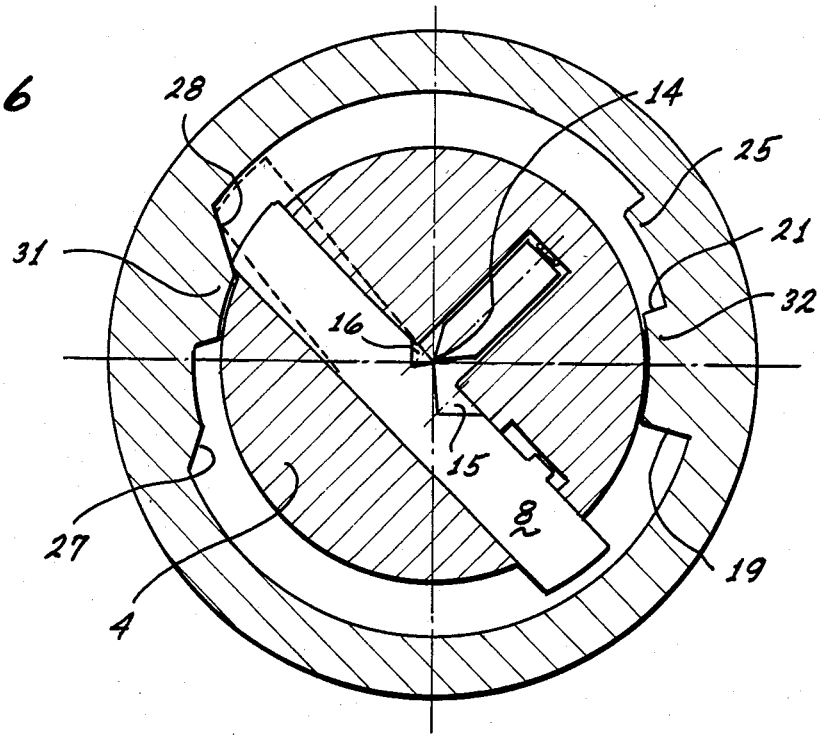

The second cam 28, shown in a particular operating state in FIG. 6, will be used upon return of the disk 4, i.e. upon rotating the ignition key and disk 4 in counterclockwise direction, This counterclockwise rotation causes the disk 4 to be returned to the resting position of FIG. 1. The second end position is shown in FIG. 5, and the blade 14 has actually penetrated completely into the groove 15 to lock the slide lock 8 in the second end position. The second cam 28, causes the slide lock 8 to return to the first end position during the counterclockwise return motion of disk 4. This way the edge 14 is forced out of the groove 15 and instead will enter the groove 16, which permits the slide to come to a position of abutment with the edge 19 as shown in FIG. 1.

After having described the basic positions with reference to end positions of disk 4 as well as slide lock 8, we proceed to the description of operation.

The resting position of course is shown in FIG. 1. Herein slide lock 8 is held by operation of the edge 14, through engagement with and insertion in the grooves 16. If now by operation of the ignition key, disk 4 is turned, in clockwise direction, covering approximately 120 degrees, a position is attained as shown for example in FIG. 2. The slide lock 8 is held in this first end position by edge 14. On the other hand, the arcuate end face 11 of the end 20 of slide lock 8, slides along what is the lower cylindrical surface portion 18 of chamber 2.

Figure 2:
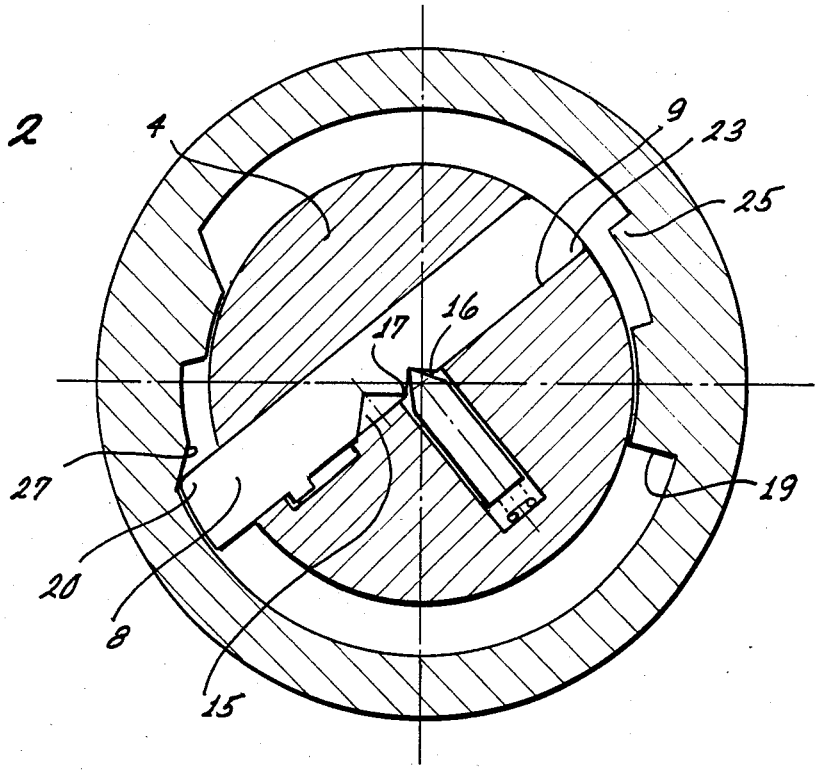
Figure 3:
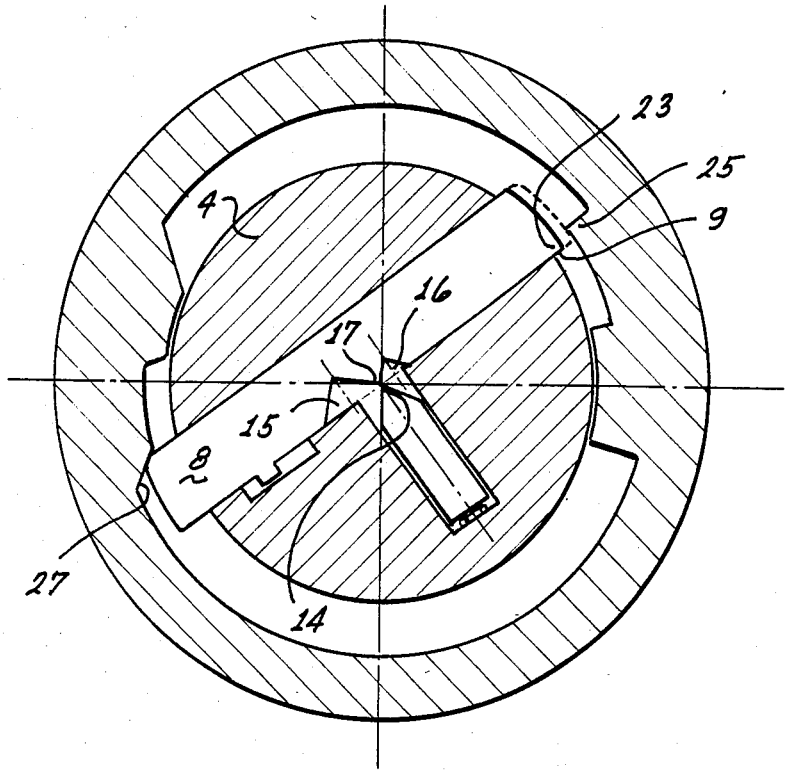

In the position shown in FIG. 2 the situation is such that the slide lock 8, with its first end 20 is just about ready to engage the cam 27, which it will do, if from the position shown in FIG. 2 the rotation of the disk 4 continues in clockwise direction. The cam 27 will now force the slide lock 8 from its first end position such that the spring bias of the edge 14 is overcome and the edge 14 will be forced out of the groove 16. The edge 14 will pass over the crestline 17. However, before this can happen, i.e. before in terms of time, edge 14 passes across the crest line 17, the end portion 23 of slide lock 8 has already passed the edge 26 (third stop) of shoulder 25, which means that it will not be possible upon continued clockwise rotation of disk 4 for the slide lock 8 to have its second end 23 reach the second end. This in turn means, that upon further rotation from the position shown in FIG. 3, the edge 14 will not completely be able to penetrate through groove 15, simply because as shown in dash-dot lines in FIG. 3, soon the end portion 23 will abut the shoulder 25.

Figure 4:
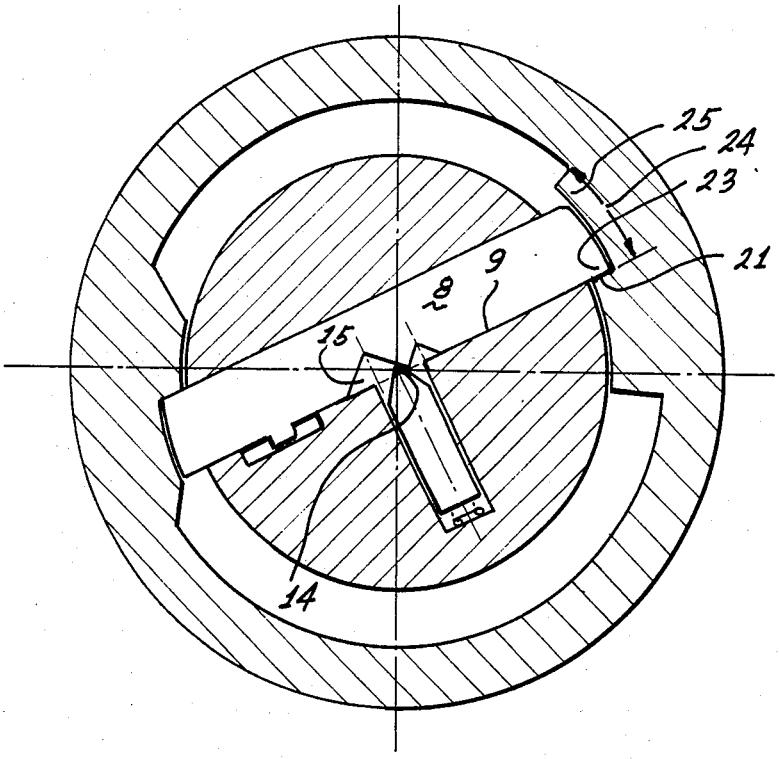

The final position of disk turning is shown in FIG. 4. The end portion 23 on one hand, is restricted from further radial outward movement by the shoulder 25, while end portion 23 abuts shoulder 21. As stated ignition (engine starting) is carried out in the position as explained in my copending application, Ser. No. 769,472 filed Aug. 26, 1985. The first end 20 of slide lock 8 on the other hand, engages the cam surfaces 27*a* which is coaxial and concentrically with the remainder of the system but will not permit the slide lock 8 to be pushed further. It is now simply assumed that as a result of the operation of the ignition key k-FIG. 7, the ignition circuit, i.e. the circuit for the starter for the engine is closed, whenever the disk 4 has any of the positions in between the positions shown in FIG. 3 and FIG. 4. This means that the ignition occurs already even though the slide lock 8 has not yet quite reached its second end position.

Now, as soon as the engine runs, the ignition key is returned, which means that the disk 4 is rotated in counterclockwise direction; the disk 4 will be turned out of the position shown in FIG. 4, towards the position shown in FIG. 5. This means that the second end 23 of the slide 8 will be freed from the shoulder 25 and now by operation of the spring 13, edge 14 will be permitted to completely penetrate the groove 15, which in turn means, that the engagement of the edge 14 with that one side wall of groove 15, will cause the slide lock 8 to be shifted into its second end position. This is shown in FIG. 5.

If now, for some reason or another the user attempts to repeat the starting he will try to turn the disk 4 again in clockwise direction. But now, end 23 abuts the stop 26 and that prevents disk 4 from turning out of the position shown in FIG. 5 in clockwise direction, therefore the current circuit for the starter remains open. This condition maintains until upon returning disk 4, this turning motion has progressed so that second end 23 of the slide lock 8 runs against the cam 28, to return the slide lock 8 from the second end position as shown in FIG. 5 to the first end position shown in FIG. 1. The return is depicted in FIG. 6.

In this operating state however, the ignition circuit is such that it will stop the engine, only then after the slide lock 8 through the cam 28 has returned to the first end position, as shown for example. in FIG. 1, will it be possible to repeat the ignition operation. This as just stated, however, presupposes that the engine had been turned off in the meantime.

In furtherance of the invention, it is suggested to provide a return spring S which is tensioned (biased) when the slide lock 8 is removed out of the first end position towards the second end position and this return spring possibly in conjunction with a manual return of the ignition key, causes the disk 4 to traverse the first part of the return path, so that end 23 clears shoulder 25 i.e. until the end portion 23 is moved slightly counterclockwise away from the stop 26.

Another particular advantage of the invention is to be seen in features which ensure the transition of the slide from the intermediate position into the end position, which is carried out by cooperation between the V-shaped groove 15 and the blade or edge 14. This is obtained by providing this particular groove 15 with a greater depth than the other one.

Guiding the disk 4 through its turning motion can be supported in accordance with another feature of the invention in that the radially reduced portions, along the cylindrical wall 18 and particularly in between the two cams and the first and the second stops, serve as centering and guiding surfaces for the disk 4. These parts are specifically designated by reference numeral 31 and 32.

The invention is not limited to the embodiments described above, but all changes and modifications thereof, not constituting departures from the spirit and scope of the invention are intended to be included.

We claim:

1. Repeat lock and inhibitor for ignition devices, for preventing repeated operation of a starter in a combustion engine, comprising:

having a substantially cylindrica interior space, there being a center accordingly;

a flat disk having a circular periphery and being disposed in said space and coaxially thereto for rotation on the center, the disk being rotated upon insertion of an ignition key in an ignition lock and upon turning thereof, said disk having its circular periphery spaced from the cylindrical interior wall of said case;

said disk being provided with a chord like channel, bounding said center on one side;

a slide lock, slidably held in the channel, having curved end pieces being complementary to the circular periphery of the disk, and being longer than said channel but shorter than the internal diameter of said cylindrical space;

the slide lock having two juxtaposed grooves with a common apex line as border, the apex or crest line running transversely to the direction of movement and length extensions of the slide lock;

a spring biased lock element in the disk and having an edge for entering the groove to thereby hold the slide lock in a first and second end position respectively, the end positions differing as to which of respectively first and seconds ends of the slide lock extends beyond the periphery of the disk;

a first, radially inwardly extending extension of the case defining a first stop for engaging the first projecting end of the slide lock when in the first end position;

a second and a third stop defined by radial inward extension of the case and being separated by a shoulder having dimension such that upon radial abutment with the second end of the slide lock the latter is prevented from assuming the second end position, the second stop positioned at an end of the shoulder for engagement with the second end of the slide lock and in ignition position of the disk, preventing further turning of the disk;

the third stop being at another end of the shoulder such that the slide lock when in the second end position abuts the third stop upon attempting repeat ignition and turning of the disk and key towards ignition position; the bias of the blade shifting the slide lock into the second end position, when upon opposite rotation of the disk the second end of the slide lock clears the shoulder;

first cam means for engaging the first end of the slide lock and shifting same as the disk is turned out of a resting position toward ignition but said shifting being not farther than permitted by the shoulder; and second cam means effective on turning of the disk in opposite direction and engaging the second end of the slide lock into the first end position, further rotation then being prevented upon abutment of the slide lock element with its first end against said first stop.

2. Repeat lock as in claim 1, and including spring means for causing the disk to move in the opposite direction following abutment against the second stop.

3. Repeat lock as in claim 1, including means for guiding and centering said disk being extensions from said interior wall of the case and being disposed next to and constituting part of said second cam means, as well as an extension, as it extends angularly from the first to the second stop.

4. Slide lock as in claim 1, said lock element being a blade or edge on a hollow blind bore like pin, there being a spring in said hollow pin to obtain the spring bias.

5. Repeat lock as in claim 1, one of the grooves in which the lock element enters to hold the slide lock in the second end position being deeper and wider than the other groove.

* * * * *